US010150283B2

(12) United States Patent
Chassot et al.

(10) Patent No.: US 10,150,283 B2
(45) Date of Patent: Dec. 11, 2018

(54) CONTROL PROCESS FOR INTAGLIO PRINTING AND CONTROL STRIP FOR THIS PURPOSE

(71) Applicant: KBA-NOTASYS SA, Lausanne (CH)

(72) Inventors: Daniel Chassot, Bienne (CH); Raymond Heritier, Lausanne (CH); Denis Voros, Ecublens (CH)

(73) Assignee: KBA-NOTASYS SA, Lausanne (CH)

( * ) Notice: Subject to any disclaimer, the term of this patent is extended or adjusted under 35 U.S.C. 154(b) by 22 days.

(21) Appl. No.: 14/653,622

(22) PCT Filed: Dec. 20, 2013

(86) PCT No.: PCT/IB2013/061170
§ 371 (c)(1),
(2) Date: Jun. 18, 2015

(87) PCT Pub. No.: WO2014/097227
PCT Pub. Date: Jun. 26, 2014

(65) Prior Publication Data

US 2016/0185100 A1 Jun. 30, 2016

(30) Foreign Application Priority Data

Dec. 20, 2012 (EP) ..... 12198762

(51) Int. Cl.
*B41M 3/14* (2006.01)
*B41F 11/02* (2006.01)
(Continued)

(52) U.S. Cl.
CPC ..... *B41F 9/08* (2013.01); *B41F 9/021* (2013.01); *B41F 9/063* (2013.01); *B41F 11/02* (2013.01);
(Continued)

(58) Field of Classification Search
None
See application file for complete search history.

(56) References Cited

U.S. PATENT DOCUMENTS 4,003,311 A * 1/1977 Bardin ..... B41M 1/10 101/170
4,516,496 A 5/1985 Giori
(Continued)

FOREIGN PATENT DOCUMENTS

CH 477293 10/1969
EP 0091709 3/1983
(Continued)

OTHER PUBLICATIONS

Handbook of Print Media, Helmut Kipphan, 2001, Springer, pp. 425-426.*
(Continued)

*Primary Examiner* — Joshua D Zimmerman
(74) *Attorney, Agent, or Firm* — Nixon & Vanderhye P.C.

(57) ABSTRACT

It is especially described a control process for intaglio printing, in particular for printing paper securities, such as banknotes. This control process includes defining on an intaglio printing plate (80) control areas (150, 151-155; 170, 171-179) designed in such a manner as to allow in particular evaluation of effects of the printing pressure applied during printing of a substrate by means of the intaglio printing plate (80) and evaluation of effects of the ink coverage applied during inking of the intaglio printing plate (80), which control areas (150, 151-155; 170, 171-179) are engraved in a portion of the intaglio printing plate (80) in order to produce corresponding printed control zones (160, 161-165) on the substrate. The process further includes carrying out of measurements in the printed control zones allowing evaluation of the printing pressure applied during printing of the
(Continued)

substrate as well as of the ink coverage applied during inking of the intaglio printing plate (80).

12 Claims, 9 Drawing Sheets

(51) Int. Cl.

| | |
|---|---|
| ***B41F 9/08*** | (2006.01) |
| ***B41F 33/00*** | (2006.01) |
| ***B41F 9/02*** | (2006.01) |
| ***B41F 9/06*** | (2006.01) |
| ***B41N 1/14*** | (2006.01) |

(52) U.S. Cl.
CPC ..... *B41F 33/0045* (2013.01); *B41M 3/14* (2013.01); *B41N 1/14* (2013.01); *B41P 2233/51* (2013.01)

(56) References Cited

U.S. PATENT DOCUMENTS

| | | | |
|---|---|---|---|
| 5,062,359 | A | 11/1991 | Giori |
| 5,062,360 | A | 11/1991 | Germann et al. |
| 5,282,417 | A | 2/1994 | Germann |
| 5,899,145 | A | 5/1999 | Schaede |
| 6,111,261 | A | 8/2000 | Bolza-Schunemann et al. |
| 6,176,482 | B1 | 1/2001 | Reinhard et al. |
| 6,779,445 | B2 | 8/2004 | Schaede |
| 6,840,721 | B2 | 1/2005 | Kaule et al. |
| 7,011,020 | B2 | 3/2006 | Dunninger et al. |
| 8,230,786 | B2 | 7/2012 | Giori et al. |
| 8,231,125 | B2 | 7/2012 | Hendle et al. |
| 8,516,960 | B2 | 8/2013 | Bollettin et al. |
| 8,574,714 | B2 | 11/2013 | Giori et al. |
| 8,614,834 | B2 | 12/2013 | Manfredi et al. |
| 8,781,204 | B2 | 7/2014 | Lhoweg et al. |
| 8,973,915 | B2 | 3/2015 | Hendle et al. |
| 2001/0043842 | A1 | 11/2001 | Kaule et al. |
| 2003/0010233 | A1 | 1/2003 | Schaede |
| 2004/0232108 | A1 | 11/2004 | Giori |
| 2004/0237816 | A1 | 12/2004 | Dunninger et al. |
| 2005/0127595 | A1 | 6/2005 | Hendle et al. |
| 2006/0144265 | A1 | 7/2006 | Dunninger et al. |
| 2007/0181016 | A1 | 8/2007 | Schaede |
| 2009/0059304 | A1 | 3/2009 | Manfredi et al. |
| 2009/0096156 | A1 | 4/2009 | Hendle et al. |
| 2009/0183644 | A1 | 7/2009 | Bollettin et al. |
| 2010/0195894 | A1 | 8/2010 | Lohweg et al. |
| 2010/0223927 | A1 | 9/2010 | Oku et al. |
| 2011/0068509 | A1 | 3/2011 | Perrier |
| 2012/0237087 | A1* | 9/2012 | Wu ..... H04N 1/52 382/112 |
| 2012/0312179 | A1 | 12/2012 | Scheade et al. |
| 2012/0312180 | A1 | 12/2012 | Scheade et al. |
| 2012/0328179 | A1 | 12/2012 | Glock et al. |
| 2013/0112095 | A1 | 5/2013 | Schaede et al. |
| 2014/0218502 | A1 | 8/2014 | Schaede et al. |
| 2015/0040785 | A1 | 2/2015 | Turke et al. |

FOREIGN PATENT DOCUMENTS

| | | |
|---|---|---|
| EP | 0406157 | 3/1990 |
| EP | 0415881 | 8/1990 |
| EP | 0563007 | 2/1993 |
| EP | 0873866 | 3/1998 |
| EP | 1602483 | 6/2004 |
| IN | 118869 | 8/1969 |
| WO | WO 97/36813 | 10/1997 |
| WO | WO 97/37329 | 10/1997 |
| WO | WO 97/48555 | 12/1997 |
| WO | WO 01/54904 | 8/2001 |
| WO | WO 03/047862 | 6/2003 |
| WO | WO 03/070465 | 8/2003 |
| WO | WO 03/103962 | 12/2003 |
| WO | WO 2004/026580 | 4/2004 |
| WO | WO 2005/090090 | 9/2005 |
| WO | WO 2005/118294 | 12/2005 |
| WO | WO 2007/116353 | 10/2007 |
| WO | WO 2007/119203 | 10/2007 |
| WO | WO 2008/146262 | 12/2008 |
| WO | WO 2009/138901 | 11/2009 |
| WO | WO 2011/018764 | 2/2011 |
| WO | WO 2011/077348 | 6/2011 |
| WO | WO 2011/077350 | 6/2011 |
| WO | WO 2011/077351 | 6/2011 |
| WO | WO 2011/161656 | 12/2011 |
| WO | WO 2012/131581 | 10/2012 |
| WO | WO 2012/140384 | 10/2012 |

OTHER PUBLICATIONS

International Search Report of PCT//IB2013/061170 and translation.
Written Opinion of PCT/IB2013/061170.

* cited by examiner (I-I)

CONTROL PROCESS FOR INTAGLIO PRINTING AND CONTROL STRIP FOR THIS PURPOSE

This application is the U.S. national phase of International Application No. PCT/IB2013/061170 filed 20 Dec. 2013 which designated the U.S. and claims priority to EP Patent Application No. 12198762.2 filed 20 Dec. 2012, the entire contents of each of which are hereby incorporated by reference.

TECHNICAL FIELD

The present invention relates in particular, to a control process for intaglio printing, as well as a control strip intended for intaglio printing, in particular for printing paper securities, such as banknotes. The present invention also relates to the use, as well as the application of such a control strip for verifying printability of a security pattern which is intended to be printed by intaglio printing, as well as for controlling and, if need be, adjusting printing parameters of an intaglio printing press.

TECHNOLOGICAL BACKGROUND

Intaglio printing is a secular printing technique which consists of printing patterns in relief by means of an engraved printing plate (which is designated within the context of the present invention by the expression "intaglio printing plate"). The intaglio printing plate is inked on its surface by means of one or several inks. The surplus of ink outside the engravings is then wiped and pushed inside the engravings. The thus inked and thus wiped printing plate is applied against a printable substrate (for example security paper) in a press exerting a high printing pressure and pressing the substrate against the printing plate in such a manner that the ink from the engravings is transferred onto the substrate. The result is a document comprising a printed pattern reflecting the engraved patterns with an additional relief or embossing, matching the printed pattern, which relief or embossing reflects the depth of the engravings and which is typically recognizable to the touch.

Intaglio printing presses, such as used for producing paper securities, in particular banknotes, are for example described in Swiss patent No. CH 477 293 A5, in European patent applications published under Nos. EP 0 091 709 A1, EP 0 406 157 A1, EP 0 415 881 A2, EP 0 563 007 A1, EP 0 873 866 A1, EP 1 602 483 A1, and in International applications published under Nos. WO 01/54904 A1, WO 03/047862 A1, WO 2004/026580 A1, WO 2005/118294 A1, WO 2011/077348 A1, WO 2011/077350 A1, WO 2011/077351 A1, all in the name of the present Applicant.

For a long time, intaglio printing plates were engraved by hand in a plate of soft metal, for example copper, brass or another suitable metal or metal alloy. The tools used by the engraver were typically constituted of burins or styluses the end of which was sharpened and suited to the desired dimensions of the patterns to be engraved, the latter patterns being constituted essentially of lines and curves modulated in dimensions, according to the action exerted by the engraver, to produce variations in tone reproducing the half-tones of the image to be engraved, for example a portrait.

More recently photolithographic techniques have been proposed in order to facilitate the transfer of images on the intaglio printing plates, as well as computer-assisted engraving processes.

The intaglio printing technique is especially used in the field of printing of paper securities, in particular for printing banknotes, intaglio printing remaining one of the most difficult printing techniques to counterfeit.

In the context of printing of paper securities, in particular printing of banknotes, techniques have been developed for assisting the engraver in his task, in particular with a view to reducing the required engraving time as well as the time for producing printing plates. The approach adopted up until very recently consisted in producing a unique engraved original (by hand or assisted by technical engraving means) representing one single document to be printed, and replicating this original as many times as needed to produce a printing plate comprising several replicas identical to said original. According to this approach, the employed engraving technique adheres essentially to that of an engraver, that is to say, that each pattern is engraved according to the outline of the relevant line or curve, that is to say in a substantially vectorial manner (see for example International application published under No. WO 97/48555 A1).

The present Applicant has proposed an innovative approach for producing intaglio printing plates, an approach which is described in International application published under No. WO 03/103962 A1 (which application is incorporated by reference in its entirety within the context of the present application). This process consists in generating a set of three-dimensional digital data constituted of pixels each representing an elementary point to be engraved in the surface of the plate, the engraving being operated pixel by pixel on the basis of said three-dimensional digital data. According to this technique, a printing plate may be engraved directly. Alternatively, a printing plate precursor (advantageously a metal plate having a polymer layer) may be engraved. In this last case, it is the polymer layer that is engraved and the thus engraved precursor is then used to make printing plates by galvanic replication. Furthermore, the engraving is advantageously performed by laser. This engraving process, whether direct or indirect, is put into practice commercially by the Applicant under brand name CTiP® (Computer to Intaglio Plate®) and has become so to speak a standard in the security printing industry.

Contrary to the prior approach which consisted in making a unique engraved original representing one single document to be printed, a plate in its entirety may be engraved in one single phase, without having to undergo the tedious process of replicating an original. According to the technique described in International application No. WO 03/103962 A1, the replication of the original on the plate is carried out within a digital environment, thus allowing in particular to compensate for the distortions of the paper occurring during intaglio printing, a compensation which was simply impossible by using the previously employed techniques. Furthermore, the technique described in International application No. WO 03/103962 A1 allows creating patterns which extend from one banknote to another, without discontinuities, that is to say patterns which extend up to the edge of the banknote without interruption (as can be seen on the illustration of FIG. 1 discussed further below).

A considerable advantage of the aforementioned technique resides in the fact that it is substantially independent from the complexity of the patterns to be engraved, whereas the prior techniques are dependent on the level of complexity of the engravings to be performed.

An evolution of the technique described in International application No. WO 03/103962 A1 for the direct engraving of intaglio printing plates, is described in International application published under No. WO 2009/138901 A1

(which application is also incorporated by reference in its entirety within the context of the present application).

These various computer-assisted techniques have allowed the development of a large variety of security elements taking advantage of the advantageous properties of intaglio printing, amongst which in particular dual-tone or multi-tone elements which make use of the variations in tonal value of the intaglio ink, continuous background, latent images, positive/negative micro-print, tactile elements, etc. Thanks to these techniques, security elements of high complexity, allowing to effectively fight counterfeiting, may be created. Illustrating examples are presented in particular in International applications published under Nos. WO 2005/090090 A1 and WO 2007/119203 A1.

FIG. 1 shows by way of illustration a reproduction in black and white of a banknote specimen produced by the Applicant and distributed to the public on the occasion of the XIX$^{th}$ International Security Printers Conference organized by Intergraf (www.intergraf.eu) and which was held during the month of May 2003 in Montreux (Switzerland). This specimen, representing Lord Byron, was produced according to the aforementioned CTiP® process, the set of elements visible on FIG. 1 constituted of multicolored elements printed by intaglio printing. One in particular recognizes multi-tone elements around and underneath the portrait of Lord Byron (on the right) as well as around and under inscriptions "CTIP" and "COMPUTER TO INTAGLIO PLATE" (on the left), as well as a set of other intaglio elements taking advantage of the possibilities offered by the CTiP® technology. This specimen illustrates the degree of complexity of elements which may be created by intaglio printing, particularly by means of the aforementioned CTiP® process.

A difficulty resulting from the availability of the modern techniques allowing to create intaglio elements resides in the fact that the engraver (one may also talk of "designer" in as far as the intaglio security pattern is as of now created in a computer environment) has a near unlimited freedom with respect in particular to the definition of dimensions (line width, depth, etc.) and profiles (square, "U-shaped", "V-shaped", etc.) of engravings. Nevertheless, this freedom is not directly transposable to the print, namely that not any type of engraving is necessarily printable. Intaglio printing remains subjected to physical and mechanical constraints of which it is not possible to be free of. By way of extreme illustration, it is theoretically possible to design and create engravings of fine width and great depth, for example an engraving exhibiting a line width of 10 μm for a depth of 100 μm, however, such a structure can hardly be inked and cannot be correctly printed in as far as the substrate cannot deform in order to "get" the ink inside such an engraving. Likewise, an engraving of large surface area (several mm$^2$) is not printable without there being provided adequate structures for retaining the ink inside the engraving. Indeed, in the absence of such ink retaining structures, wiping of the intaglio printing plate would lead to an overly important removal of ink applied inside the engraving. Compromises must therefore be made in practice, these compromises particularly implying a certain correlation between the line width, the depth of the engraving, and the profile of the engraving. These compromises must also take into account the overall security pattern to be intaglio printed, as even though one individual element is potentially printable with certain printing parameters, these printing parameters could well not be adapted for printing the other elements of the security pattern. The quality of an intaglio print is thus directly linked to the quality of realization of the plate. It is also worth mentioning that other factors influence the quality of an intaglio print, namely, in particular:

- the quality and complexity of the substrate to be printed, particularly the integration of more and more varied and numerous security elements;
- the intaglio inks which typically exhibit variations in viscosity, different formulations, various drying properties, etc.;
- machine settings, particularly printing pressure, inking, contact settings, temperature, etc.

Regarding machine settings, the printer must in particular proceed with a setting of the printing pressure (that is to say, the pressure exerted between the intaglio printing plate and the substrate to be printed), the ink coverage (that is to say, the quantity of ink applied onto the intaglio printing plate) and the wiping. These printing parameters notably influence the intaglio printing result. Mastering these various printing parameters is therefore crucial, particularly in order to ensure a good repeatability of the print and avoid overly important variations in terms of printing quality.

In practice, the printer is therefore confronted essentially with two main issues, namely:

(i) to ensure that the set of engravings forming the security pattern to be intaglio printed be indeed printable (it can thus be spoken of a verification of the printability of the security pattern and a validation of the engravings); and (ii) to further ensure that the set of intaglio elements forming the security pattern may be printed with regularity and constant quality, and this with printing parameters that are most suitable for mass production (it can thus be spoken of a verification of the repeatability and the variability of the print).

This however requires that the printer may be in a position to objectively evaluate and measure these characteristics on the final result as printed.

A purpose of the present invention is to meet these needs.

SUMMARY OF THE INVENTION

A general aim of the present invention is therefore to improve the techniques and solutions of the prior art.

More particularly, an aim of the present invention is to provide a solution which allows the printer to objectively evaluate and measure (and in a quantifiable manner) the ability of a security pattern to be printed by intaglio printing.

Furthermore, an aim of the present invention is to provide a solution allowing the printer to objectively carry out the basic setting of an intaglio printing press for printing a security pattern, for example a banknote, by basing oneself on objective and measurable control elements.

Another aim of the present invention is to provide a solution allowing the printer to objectively evaluate and measure (and in a quantifiable manner) the effects of the intaglio printing parameters on the printed result, particularly the balance between the printing pressure and the ink coverage as reflected on the printed result.

Yet another aim of the present invention is to provide a solution allowing the printer to quantify the variations in quality, density, positive and negative fattening of the printed lines (or "line gain") with respect to an expected result, and thus limit or attenuate the effects of these variations on printing quality, thus ensuring a good repeatability of the print.

Another aim of the present invention is to provide a solution allowing the printer to objectively and in a quantifiable manner identify and diagnose the probable source of a possible printing issue, by basing oneself on objective and measurable control means allowing the printer to include or exclude potential causes of said possible printing issue.

The present invention achieves these aims by providing a control process for intaglio printing the features of which are recited in independent claim 1.

By "intaglio printing" within the meaning of the invention, it should be understood a printing process involving:

(i) inking of at least one intaglio printing plate with at least one intaglio ink;

(ii) wiping of the intaglio printing plate thus inked; and (iii) printing of a substrate by means of the intaglio printing plate thus wiped, printing of the substrate involving application of the substrate against the intaglio printing plate at a printing pressure. In the case of intaglio printing, one should understand that the exerted printing pressure is typically very high. In the field of intaglio printing, the linear pressure exerted during printing is thus typically of the order of 10,000 N/cm. One may therefore talk of "high printing pressure" as opposed to the comparatively marginal printing pressures applied for example in the field of offset printing.

In this context, printing pressure, ink coverage and wiping constitute printing parameters that are liable to affect the intaglio printing.

The process according to the invention thus comprises the following steps:

(a) defining on the intaglio printing plate control areas designed in such a manner as to allow in particular evaluation of effects of the printing pressure applied during printing (iii) of the substrate and evaluation of effects of the ink coverage applied during inking (i) of the intaglio printing plate, which control areas are engraved in a portion of the intaglio printing plate in order to produce corresponding printed control zones on the substrate;

(b) carrying out measurements in the printed control zones allowing evaluation of the printing pressure applied during printing (iii) of the substrate (in order to determine if this printing pressure is suitable or not); and (c) carrying out measurements in the printed control zones allowing evaluation of the ink coverage applied during inking (i) of the intaglio printing plate (in order to determine if this ink coverage is suitable or not).

Preferably, the printing pressure and the ink coverage are adjusted until the measurements carried out in the printed control zones reflect an optimal balance between the printing pressure and the ink coverage. Such an optimal balance is in particular preferably determined on the basis of measurements carried out in the printed control zones, which measurements include a measurement of the optical density, raggedness and fill.

As regards the ink coverage, should the intaglio printing plate be inked by means of a plurality of different inks (which is typically the case in practice), the control areas comprise at least one control area for each ink used, and the measurements carried out in the printed control zones are undertaken for each ink individually.

According to a preferred variant of the invention, the measurements carried out in the printed control zones include the measurement of raggedness, the measurement of fill, and the measurement of optical density in accordance with a determined measurement standard, particularly in accordance with the ISO/IEC 13660:2001 standard or the ISO/IEC TS 24790:2012 standard (which cancels and replaces the ISO/IEC 13660:2001 standard). Advantageously, the measurement of raggedness, the measurement of fill as well as the measurement of optical density are carried out on printed lines substantially oriented at ±45° with respect to a printing direction and preferably exhibiting a line width ranging between 30 μm and 200 μm.

Furthermore, it is also advantageous that the measurements carried out in the printed control zones further include the measurement of a contrast, which measurement allows an objective evaluation of the printability of multi-tone elements.

The measurements carried out in the printed control zones should preferably allow constitution of a sampling of measurements that are representative of printing of engravings of varying depths, particularly engravings the depth of which varies within a range of values lower than or equal to 70 μm.

According to an advantageous variant of the invention, the process further comprises a step which consists in verifying printability of a security pattern which is to be printed by intaglio printing by means of the intaglio printing plate, once a printer has carried out a desired setting of said printing parameters.

According to another advantageous variant of the invention, the printing parameters of an intaglio printing press are controlled and, if need be, adjusted, according to the measurements carried out in the printed control zones.

The present invention also achieves the aforementioned aims by providing a control strip the features of which are recited in independent claim 14. Advantageous variants of this control strip are discussed in the following description and from the subject-matter of the dependent claims.

The control strip according to the present invention can be particularly advantageously used for verifying printability of a security pattern which is intended to be printed by intaglio printing by means of an intaglio printing plate provided with the control strip.

The control strip according to the present invention can also be particularly advantageously used for controlling and, if need be, adjusting printing parameters of an intaglio printing press, in particular the printing pressure and the ink coverage.

The control strip according to the present invention can likewise be particularly advantageously used for controlling quality of the intaglio printing plate itself.

The present invention also relates to an engraved plate for intaglio printing, in particular an intaglio printing plate or an intaglio printing plate precursor, comprising the aforementioned control strip provided in a portion of the engraved plate, the control areas being engraved in the portion of the engraved plate, preferably in a portion forming a margin on a trailing part of the engraved plate.

In this regard, the present invention also relates to any printed substrate (for example printed sheets or a continuous printed web) that is printed by means of an intaglio printing plate according to the invention.

The present invention further relates to any digital origination file intended for the production of an intaglio printing plate, comprising a set of digital data representative of a security pattern to be engraved, as well as a set of digital data representative of the aforementioned control strip.

Other aspects of the invention form the subject-matter of the dependent claims.

BRIEF DESCRIPTION OF THE DRAWINGS

The features and advantages of the present invention will become more apparent upon reading the following detailed description of embodiments of the invention, presented only by way of non-limiting examples and illustrated by the accompanying drawings in which.

EMBODIMENTS OF THE INVENTION

Figure 2:
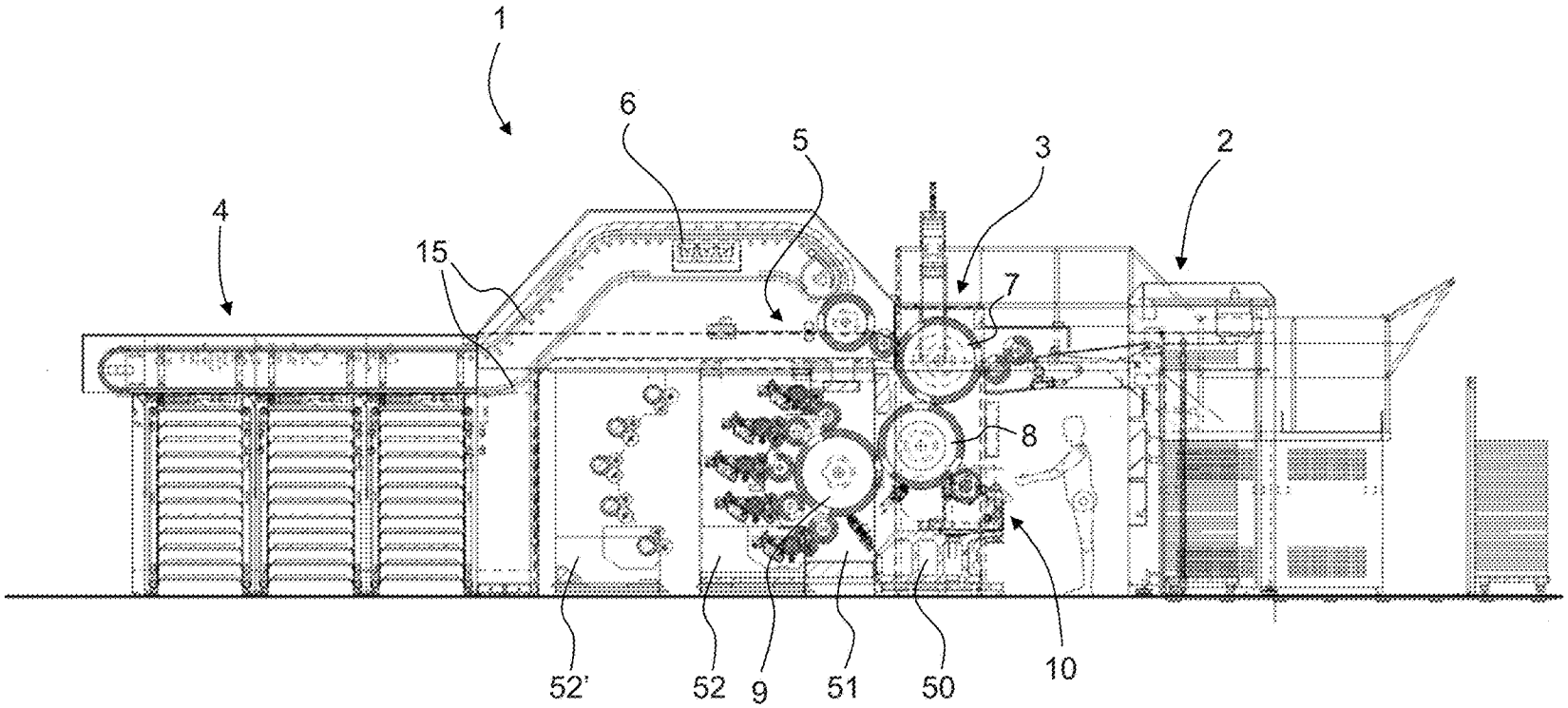
FIG. 2 shows a schematic view of an intaglio printing press such as used for the production of paper securities, in particular banknotes.

FIG. 2 schematically illustrates an intaglio printing press globally designated by numerical reference 1. More specifically, FIG. 2 shows a sheet-fed intaglio printing press 1 comprising a sheet feeder unit 2 for supplying sheets to be printed, an intaglio printing unit 3 for printing the sheets, and a sheet delivery unit 4 for collecting the newly printed sheets. The intaglio printing unit 3 comprises an impression cylinder 7 (consisting in this example of a three-segment cylinder), a plate cylinder 8 (consisting in this example of a three-segment cylinder bearing three intaglio printing plates), an inking system comprising an ink collecting cylinder, or Orlof cylinder, 9 (here consisting of a three-segment blanket cylinder bearing a corresponding number of blankets) for inking the surface of the intaglio printing plates borne by the plate cylinder 8, and an ink wiping system 10 for wiping the inked surface of the intaglio printing plates borne by the plate cylinder 8, before printing the sheets.

The sheets are supplied from the sheet feeder unit 2 on a supply table, or feeder, then transferred one by one to the impression cylinder 7. The sheets are then transported by the impression cylinder 7 to the printing nip between the impression cylinder 7 and the plate cylinder 8 where intaglio printing, strictly speaking, takes place. Once printed, the sheets are transferred from the impression cylinder 7 to a sheet transporting system 15 in order to be transported and delivered to the sheet delivery unit 4. The sheet transporting system 15 conventionally comprises a sheet conveying system comprising a pair of endless chains driving a plurality of spaced-apart gripper bars holding the sheets by their leading portion (the freshly-printed side of the sheets being oriented downward during conveyance of the sheets from the printing unit 3 towards the sheet delivery unit 4), the sheets being successively transferred to a corresponding gripper bar of the conveying system.

During their transport towards the sheet delivery unit 4, the newly printed sheets are preferably inspected by an optical inspection system 5. In the illustrated example, the optical inspection system 5 is advantageously an inspection system corresponding to the one disclosed in International application published under No. WO 2011/161656 A1, which inspection system 5 comprises a transfer mechanism and an inspection drum located at a transfer section between the impression cylinder 7 and the chain wheels driving the chains of the sheet transporting system 15. The inspection system 5 may alternatively be disposed on the path of the sheet transporting system 15, for example like the inspection systems described in International applications published under Nos. WO 97/36813 A1, WO 97/37329 A1, and WO 03/070465 A1. Such inspection systems are in particular sold by the Applicant under product designation NotaSave®.

Before delivery, the printed sheets are preferably transported past a drying or curing unit 6 disposed after the inspection system 5 along the transport path of the sheet transporting system 15. The drying or curing could, if need be, be carried out before optical inspection of the sheets.

Figure 3:
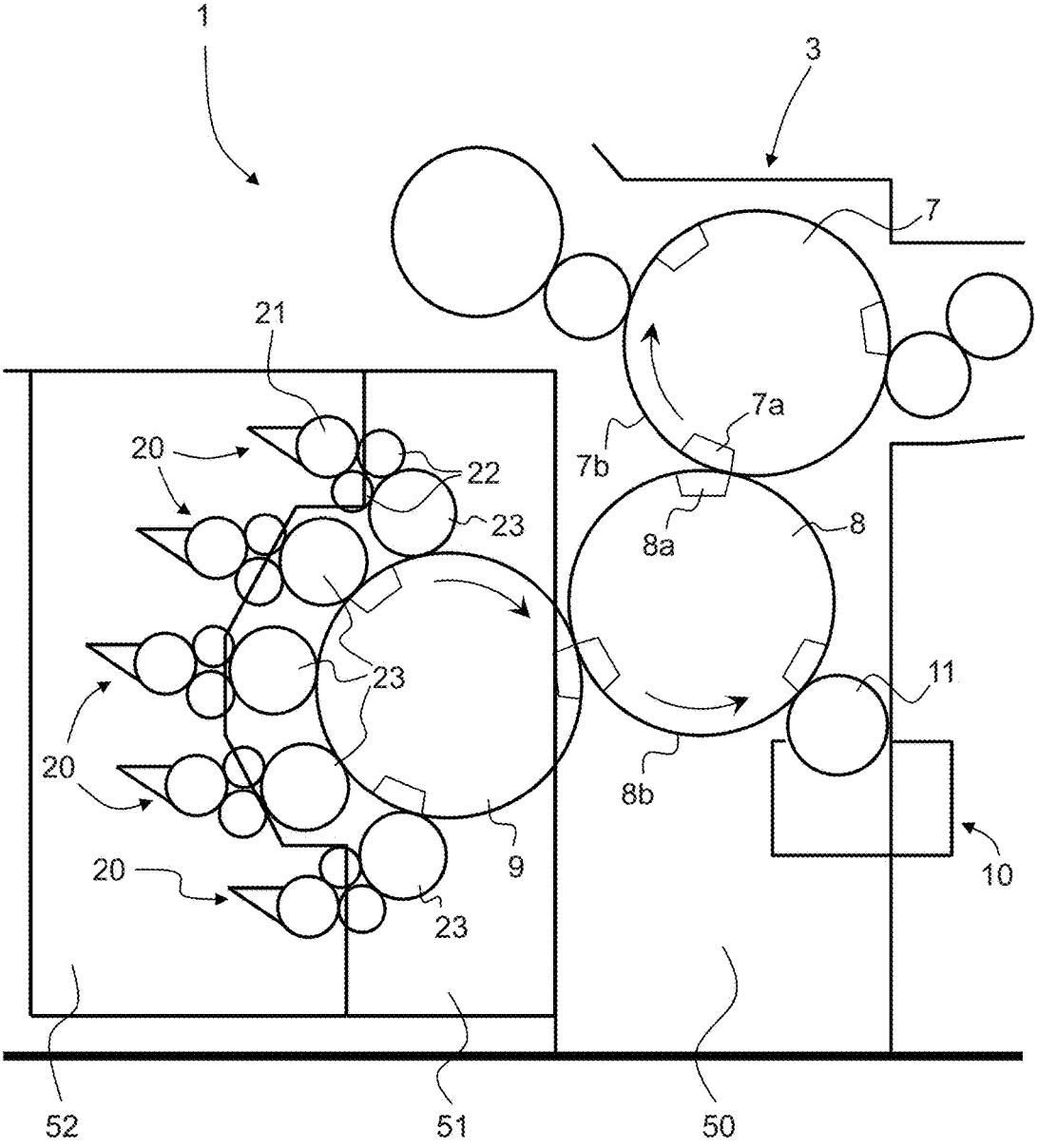
FIG. 3 shows a schematic view of the intaglio printing unit of the printing press illustrated in FIG. 2.

FIG. 3 is a schematic view of the intaglio printing unit 3 of the intaglio printing press 1 of FIG. 2. As already stated, the printing unit 3 comprises for the most part the impression cylinder 7, the plate cylinder 8 with its intaglio printing plates, the inking system with its ink collecting cylinder 9 and the ink wiping system 10. As can be seen on FIG. 3, the impression cylinder 7 and the plate cylinder 8 (in addition to the ink collecting cylinder 9) are cylinders with three segments 7*b*, resp. 8*b*, each cylinder exhibiting three cylinder pits 7*a*, resp. 8*a*, where are typically located the clamping means required for mounting the blankets (as far as the impression cylinder 7 or the ink collecting cylinder 9 is concerned) or the intaglio printing plates (as far as the plate cylinder 8 is concerned).

The inking system comprises in this example five inking devices 20, which all cooperate with the ink collecting cylinder 9 which is in contact with the plate cylinder 8. It will accordingly be understood that the illustrated inking system is suitable for indirect inking of the plate cylinder 8, namely of the intaglio printing plates, via the ink collecting cylinder 9. The inking devices 20 each comprise an ink duct comprising an ink duct roller 21 cooperating in this example with a pair of ink application rollers 22. Each pair of ink application rollers 22 in turn inks a corresponding chablon cylinder 23 which is in contact with the ink collecting cylinder 9. As is common in the field, the surface of the chablon cylinders 23 is structured in such a manner as to exhibit relief portions corresponding to the areas of the intaglio printing plates that are to receive the corresponding colored inks provided by the inking devices 20.

As illustrated in FIGS. 2 and 3, the impression cylinder 7 and the plate cylinder 8 are both supported by a (main) stationary frame 50 of the printing press 1. The inking devices 20 (including the ink duct roller 21 and the ink application rollers 22) are for their part supported in a moveable inking carriage 52, while the ink collecting cylinder 9 and the chablon cylinders 23 are supported in an intermediate carriage 51 located between the inking carriage 52 and the stationary frame 50. The inking carriage 52 and the intermediate carriage 51 are advantageously suspended under supporting rails. In FIG. 2, numerical reference 52' designates the inking carriage in a retracted position indicated in dashed lines. It is to be appreciated that the intermediate carriage 51 is also moveable.

The dual-carriage configuration of the intaglio printing press 1 such as illustrated in FIGS. 2 and 3 corresponds for the most part to the configuration described in International applications published under Nos. WO 03/047862 A1, WO 2011/077348 A1, WO 2011/077350 A1 and WO 2011/077351 A1 already cited in the preamble.

The ink wiping system 10 typically comprises a wiping tank, a wiping cylinder (or roller) 11 supported on and partially located in the wiping tank in such a manner as to come in contact with the plate cylinder 8, cleaning means (not illustrated) for removing the wiped ink residues from the surface of the wiping cylinder 11, and a drying blade (not illustrated) placed in contact with the surface of the wiping cylinder 11 in order to remove the residues of wiping solution from the surface of the wiping cylinder 11. An example of a particularly suitable wiping system is described in International application published under No. WO 2007/116353 A1.

Figure 4:
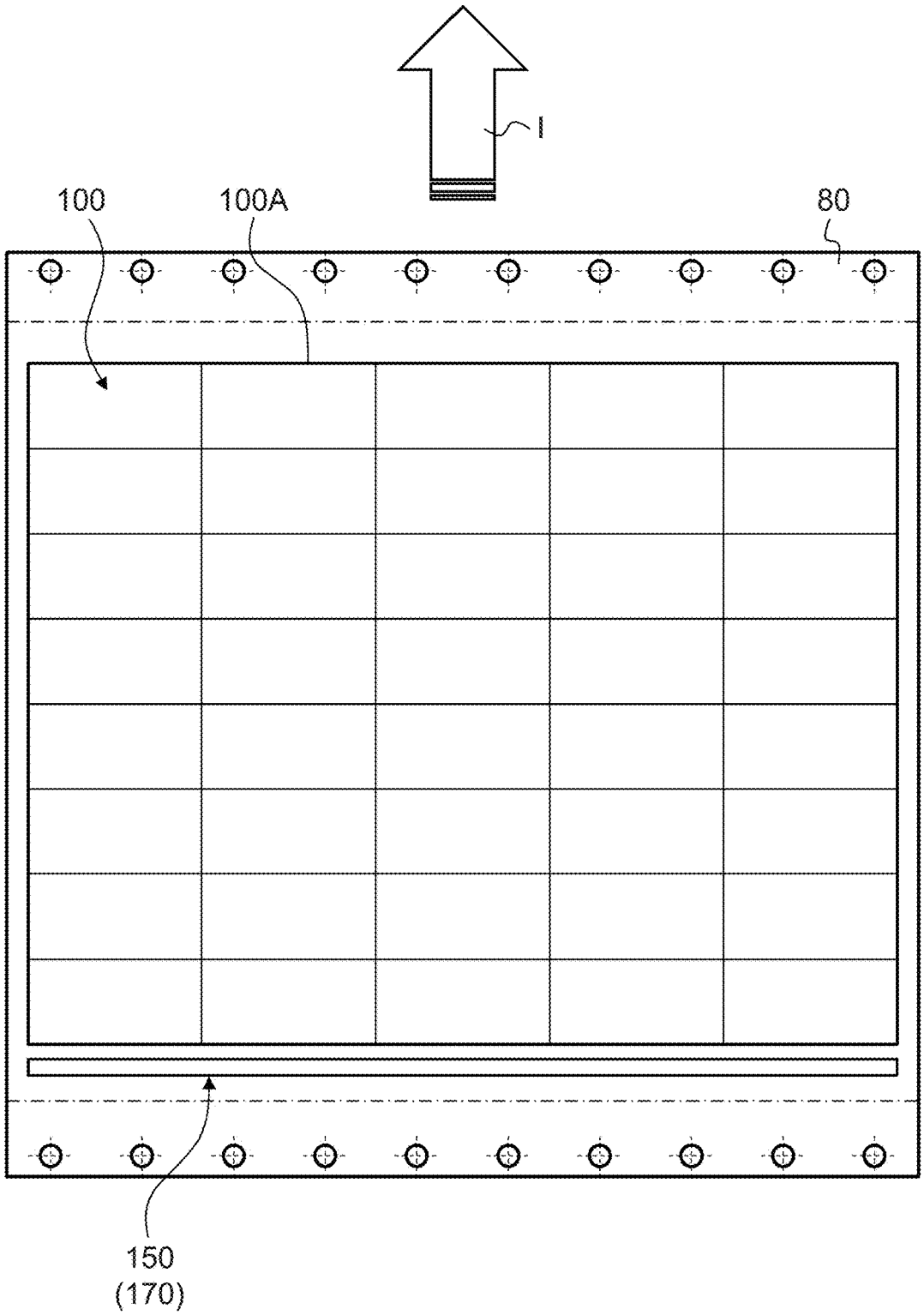
FIG. 4 is a schematic illustration of an intaglio printing plate provided with a control strip according to the invention.

A schematic example of an intaglio printing plate, globally designated by numerical reference 80, is illustrated in FIG. 4. This printing plate 80 is typically produced in a suitable metal (for example nickel or brass, other metals being however possible) the surface of which is provided with a wear resistant coating (for example a chrome coating). As illustrated, the leading and trailing ends of the intaglio printing plate 80 (with respect to the printing direction designated by the arrow I in FIG. 4) are provided with a set of holes allowing the fixation of the intaglio printing plate 80 on the circumference of a plate cylinder of an intaglio printing press (like the plate cylinder 8 of FIGS. 2 and 3).

Suitable means are typically put into practice for producing engravings in the surface of the printing plate 80. These engravings may advantageously be produced according to the principles disclosed in International applications published under Nos. WO 03/103962 A1 and WO 2009/138901 A1 already mentioned above, which both relate to the CTiP® technique developed by the Applicant. Other techniques may however be implemented in order to produce these engravings, and the present invention is not specifically limited to a particular engraving technique.

Figure 1:
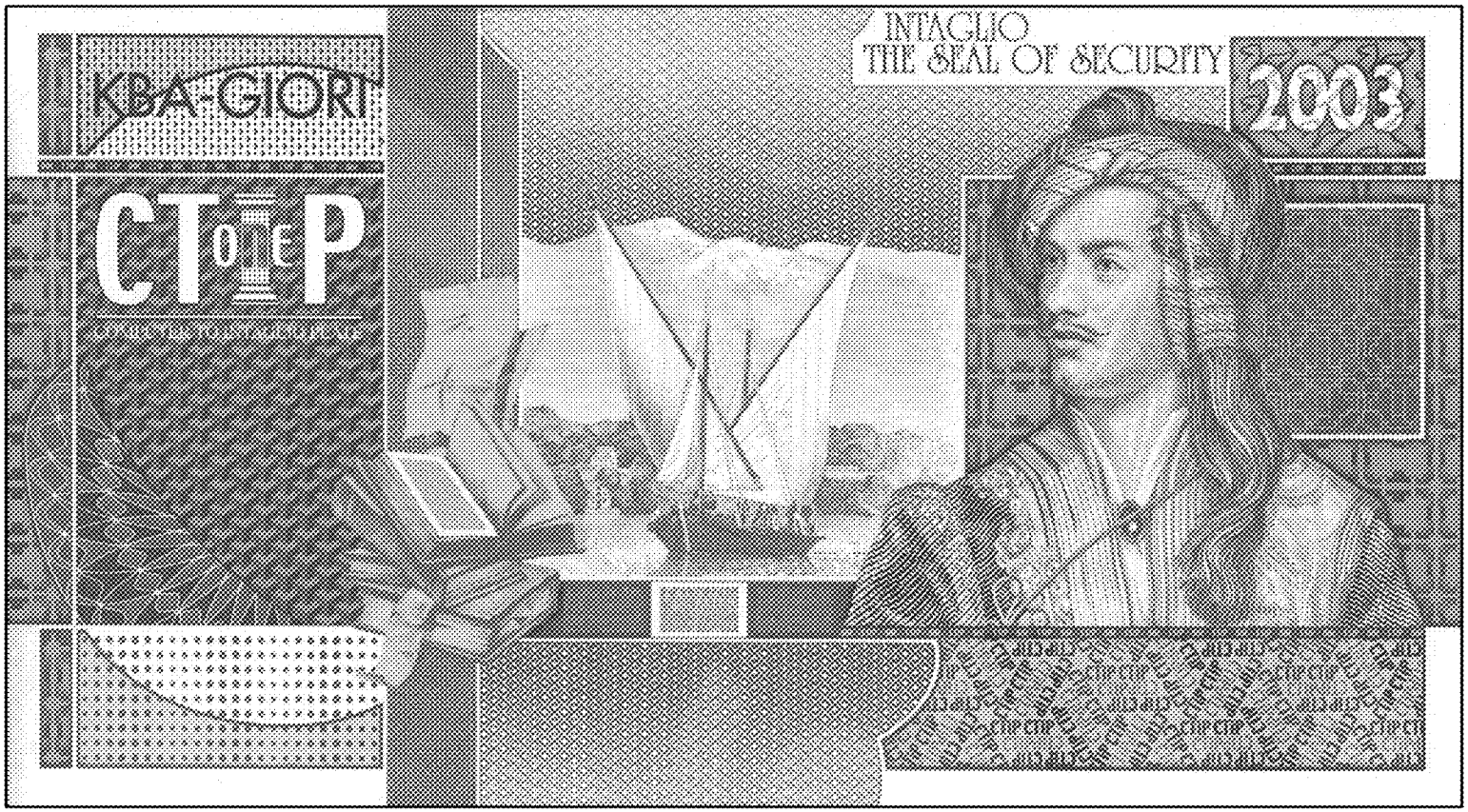
FIG. 1 shows a halftone image of a banknote specimen with the portrait of Lord Byron such as produced by the Applicant and distributed to the public during the year 2003.

Numerical reference 100 in FIG. 4 designates an individual security pattern, represented very schematically by a simple rectangular form, corresponding to a security print to be produced, for example a banknote, like that which is illustrated in FIG. 1. Numerical reference 100A designates the set of security patterns 100 which are repeated, as is typically the case, in the form of a matrix arrangement (here comprising five columns and eight rows), which is intended to be printed on the sheets.

Numerical reference 150 (as well as numerical reference 170) designates for its part a control strip according to the invention illustrated very schematically, an essential function of which is to allow a printer to carry out, on the sheets printed by means of the intaglio printing plate 80, various measurements pertaining to the intaglio print. In FIG. 4, it may be noted and pointed out that the control strip 150 (170) is provided in this example on the trailing part of the printing plate 80, in such a manner that the corresponding print is provided on the trailing part of the sheets.

Figure 5:
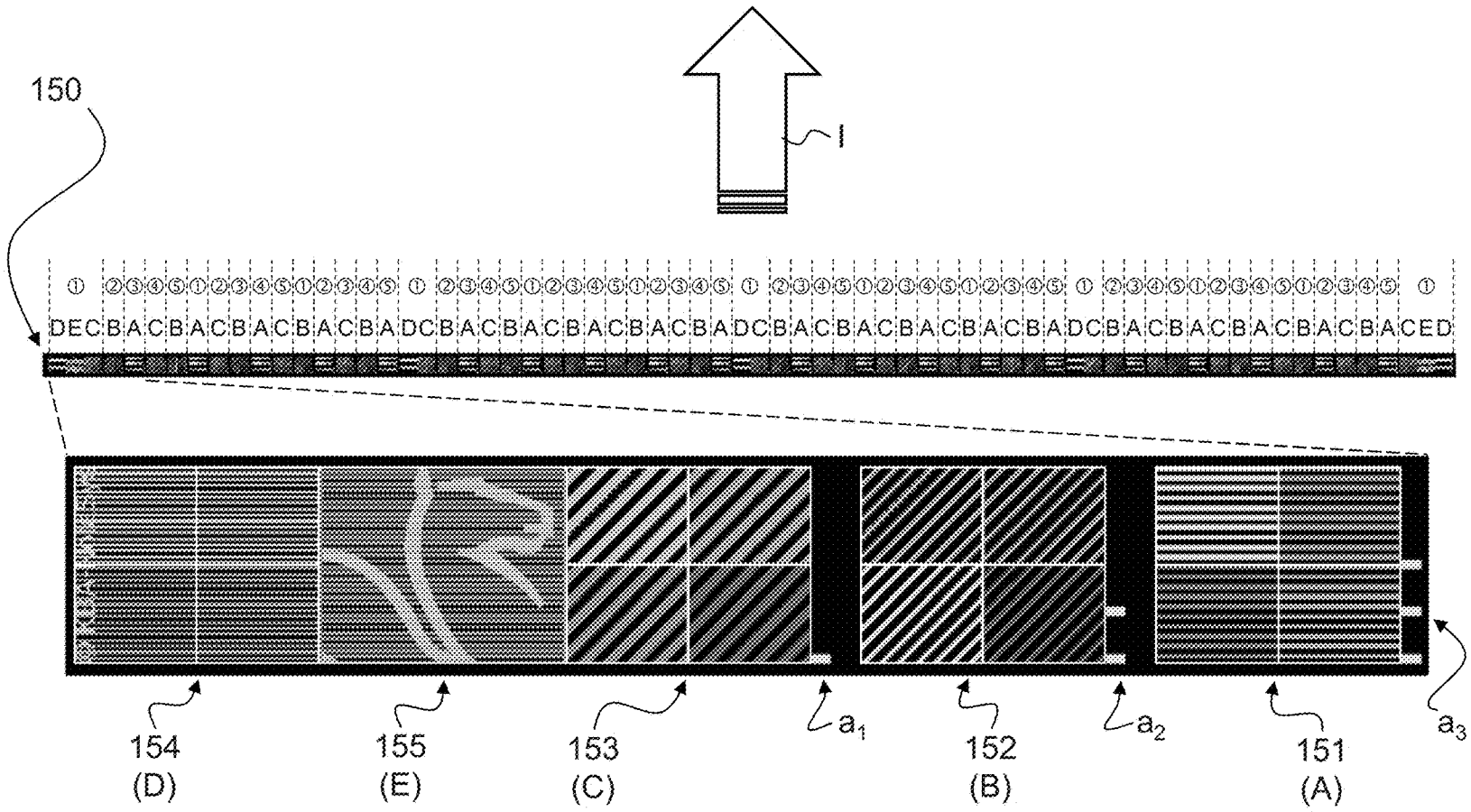
FIG. 5 schematically illustrates an example of a control strip comprising several control areas according to a first embodiment of the invention.

FIG. 5 schematically illustrates an example of a control strip, globally designated by numerical reference 150, according to a first embodiment of the invention, variants being however possible (like the other example illustrated on FIG. 7) without departing from the scope of the invention defined by the accompanying claims.

The control strip 150 illustrated in FIG. 5 comprises a set of control areas distributed along a direction perpendicular to the printing direction I. More specifically, these control areas are constituted of a predetermined set of control elements (here five) designated by references A to E in FIG. 5, which are repeated several times transversally to the printing direction I, as illustrated on the upper portion of FIG. 5.

The various control areas of the control strip are each intended to be inked by means of a determined ink. In the illustrated example, there are five inks (which corresponds to the number of inking devices 20 in the intaglio printing press 1 of FIGS. 2 and 3). References ① to ⑤ in FIG. 5 designate in this respect the ink by means of which each control area is inked.

The lower portion of FIG. 5 is an enlarged view of the first five control areas, designated by numerical references 151 to 155, on the left end of the control strip 150. The first control area 151 reflects the features of the first control element A. Likewise, the second to fifth control areas 152 to 155 respectively reflect the features of the second to fifth control elements B to E. The other control areas of the control strip 150, on the right of control area 151, such as represented on the upper portion of FIG. 5, are not detailed on the lower portion of FIG. 5 as they reflect the same structures as those of areas 151 to 155. By way of illustration, the dimensions of each control area are of the order of 4 mm in height and 5 mm in width.

More particularly, in the illustrated example, control areas 154, 155, 153 (which correspond respectively to control elements D, E, C), on the left end of the control strip 150, form a set which is inked by means of a same first intaglio ink ①. This is incidentally represented by an index $a_1$ on the right side of the control area 153, a corresponding index being provided for identifying the intaglio ink used for inking each control area or set of control areas. Control area 152 (corresponding to control element B) is for its part inked by means of a second intaglio ink ②, whereas control area 151 (corresponding to control element A) is inked by means of a third intaglio ink ③, this being represented by a corresponding index $a_2$, respectively $a_3$, on the right side of control area 152, respectively 153. These permutations between control elements A to E and inks ① to ⑤ are continued on the entire control strip 150. Thus, for example, the two control areas immediately to the right of control area 151 (which are not represented on the lower portion of FIG. 5), correspond to control elements C and B (and exhibit the same structures as those of control areas 153 and 152, except for the index indicating the ink) which are respectively inked by means of a fourth intaglio ink ④ and a fifth intaglio ink ⑤, as represented on the upper portion of FIG. 5.

Various permutations are undertaken in such a manner that at least a part of control elements A to E are reproduced in the form of control areas inked by means of the set of five intaglio inks ① to ⑤. In the example illustrated in FIG. 5, only control elements A to C are reproduced in the form of control areas inked by means of the five intaglio inks ① to ⑤. As for control elements D and E, these are only reproduced in the form of control areas inked by means of the first intaglio ink ① (like control areas 154 and 155). This is a non-limiting example, and it is incidentally perfectly possible that the set of control elements A to E be reproduced in the form of control areas inked by means of all five intaglio inks ① to ⑤.

As it will be understood hereinafter, it is above all contemplated, within the context of the present invention, to provide control areas designed to allow in particular, evaluation of the effects of the printing pressure applied during printing of the substrate and evaluation of the effects of the ink coverage applied during inking of the intaglio printing plate 80. To these ends, the control areas of the control strip 150 comprise a set of lines and/or curves exhibiting varying orientations and dimensions (width and/or depth), allowing to carry out the required measurements.

According to a preferred embodiment of the invention, the lines and/or curves are selected with regard to particularly the following considerations.

Firstly, intaglio printing depends on a vital factor, namely the printing pressure. The effect of the printing pressure is to push the substrate more or less deeply inside the engravings in order to come in contact with the ink located therein. The effect of excessive printing pressure typically potentially causes an overflow of the ink outside the engravings (hence commonly called "spitting"), which is detrimental to the sharpness and cleanliness of the printed lines. This overflow, or spitting, is also influenced by the quantity of ink that is actually present in the engravings.

Thus, a balance must be found between the printing pressure and the ink coverage in such a manner as to ensure that the fine (and shallow) lines as well as the wide (and deeper) lines may be printed correctly. The spitting phenomenon may in fact occur because of excessive ink coverage and/or because of excessive printing pressure, as these two printing parameters may individually or jointly lead to an overflow of the ink outside the engravings.

This being said, it may also be noted that variations of the ink coverage, beyond a minimum level, are hardly visible in the fine and shallow engravings as, even with a light inking, these engravings are usually well inked. The quantity of ink is determined by the volume of the engravings and the action of the wiping cylinder. Thus, even though a large quantity of ink is transmitted to the plate, it is not possible to fill the engravings beyond the available volume and the surplus outside the engravings is removed upon wiping. In other words, it is in particular possible to evaluate the effects of the printing pressure by examining the printing of fine and shallow engravings, the printing quality of these engravings being basically unaffected by the ink coverage beyond a minimum inking level sufficient for the inking of said fine and shallow engravings.

It is furthermore worth noting that the nature of the used intaglio inks, the viscosity of which may in particular vary, also has an influence on the spitting phenomenon. Furthermore, the orientation of the lines (or curves) engraved in an intaglio printing plate as well as their profile (typically "V-shaped", "U-shaped" or square) have an influence on the degree of printability of the engravings in question.

In fact, in the fiduciary industry, where cotton based fiduciary paper is still widely used, it is common practice to use so-called "short grain" paper (or "SG" paper), that is to say, paper which, once cut into sheets, exhibits fibers the orientation of which is typically perpendicular to the largest side of the sheets (which largest side is itself typically oriented perpendicularly to the printing direction). In other words, the fibers of fiduciary paper are typically oriented substantially parallel to the printing direction I (that is to say, substantially at 0° with respect to the printing direction I). It has been noted that the fibers of fiduciary paper offer to a certain extent a resistance to penetration of the paper in the engravings of the intaglio printing plate. Due to the typical orientation of the paper fibers at 0° with respect to the printing direction I, the resistance of the paper to penetration into the engravings is lesser for engravings oriented substantially vertically (that is to say engravings substantially parallel with the printing direction I). On the other hand, the resistance of the paper to penetration into the engravings is more important for engravings oriented substantially horizontally (that is to say, engravings substantially perpendicular to the printing direction I).

This being said, the printing direction I also coincides with the wiping direction, thus resulting in that the engravings oriented substantially vertically typically contain less ink than the engravings oriented substantially horizontally, which are perpendicular to the wiping direction and hence retain the ink better.

These general considerations were therefore taken into account for designing the control elements A to E represented on FIG. 5.

As regards control element A, reproduced in particular in the form of control area 151 in FIG. 5, a goal is to produce a set of horizontal lines (that is to say, perpendicular to the wiping direction I). By way of illustration, it consists here of a set of about twenty lines exhibiting a line width (lw) of the order of 100 μm and a line spacing (ls) of the order of 100 μm, namely a line density of the order of 50 lines/cm. Preferably, control element A is subdivided into four quarters and the line depth (ld) is different for each quarter, in a range of values preferably lower than or equal to 40 μm. By way of example, the four quarters of the control element A exhibit depths of 12 μm, 18 μm, 25 μm and 35 μm.

Control element A is mainly used in order to carry out contrast measurements between the different quarters composing the control element, and thereby evaluate the printing quality of multi-tone elements. As a reminder, a multi-tone element is generally printed by means of a single intaglio ink and exhibits variations in tones typically resulting from a variation of depth of the engraving in a range of values of the order of a few microns to about 40 μm. Control element A thus replicates the typical variations of depth of engravings used for the creation of multi-tone elements.

Control element D, reproduced in particular in the form of control area 154 in FIG. 5, is so to speak similar to control element A, with however horizontal lines exhibiting a lesser line width (lw) (for example of the order of 60 μm) and a greater line density. In this respect, control element D replicates, not in its form but in the values of line width, interline spacing and depths, typical values for printing micro-texts. This control element D is subdivided into four quarters, with a gradually decreasing level of printability, that is to say, that the decreasing printability makes the relevant quarter more difficult to print than the previous quarter, and therefore requires an increase in the printing pressure. Control element D thus allows a control of the printing pressure on four levels. In the illustrated example, control element D is only printed by means of the first intaglio ink ①. The printability of the control element D may be evaluated with the naked eye or, preferably, by a measurement of the rate of fill as outlined hereinafter. The correct printing, that is to say, without broken or interrupted lines, of at least one of the four quarters composing control element D poses the bases of a suitable pressure setting for printing fine elements, such as micro-texts.

Control elements B and C, reproduced in particular in the form of control areas 152 and 153 in FIG. 5, are, for their part constituted of a set of lines oriented at ±45° with respect to the printing direction I (and the wiping direction). This orientation of the lines at ±45° is particularly advantageous within the context of the present invention, in as far as these lines exhibit a median position which is neutral with respect to the orientation of the paper fibers and with respect to the wiping direction. Measurements carried out by means of control elements B and C should accordingly allow to be free to a certain extent of the effects of the paper fibers and of the wiping direction. These control elements B and C mainly serve to measure the balance between the printing pressure and the ink coverage. As will be seen hereinafter, the measurements preferably include the measurement of raggedness, fill, and optical density of the lines.

As regards more particularly control element C, one talks about here, by way of illustration, a set of lines at ±45° exhibiting a line width (lw) of the order of 200 μm and a line spacing (ls) of the order of 160 μm. As regards control element B, one talks about, again by way of illustration, a set of lines at ±45° exhibiting a line width (lw) of the order of 100 μm and a line spacing (ls) of the order of 160 μm. Preferably, control elements B and C are also subdivided into four quarters and the line depth (ld) is different for each quarter, in a range of values lower than or equal to 70 μm (being specified that depths of engravings reaching 100 μm, or even more, are also possible). This advantageously constitutes here a sample range representative of two types of lines which are characterized by a radically different behavior in terms of printability. In fact, the wide lines (as those which characterize control element C) naturally tend to allow penetration of the substrate to be printed more deeply inside the engravings. Consequently, a disruption of the balance between printing pressure and ink coverage will be more rapidly visible on the wide lines of control element C than on the finer lines of control element B. In other words, the lines of 200 μm which constitute control element C are more sensitive to variations of the balance between the printing pressure and the ink coverage than the lines of 100 μm which constitute control element B. Furthermore, the various quarters constituting control elements B and C thus advantageously allow constitution of a sampling of measurements (particularly measurements of raggedness, fill and optical density of the lines) that are representative of printing of engravings of varying depths, particularly engravings the depth of which varies within a range of values lower than or equal to 70 μm. In the present case, each control element B and C allows constitution of a sampling of four measurements (one for each quarter).

The fifth control element E, reproduced in particular in the form of control area 155 in FIG. 5, is constituted by way of illustration of a set of horizontal lines (with a density of lines comparable to the lines of control element D) combined with a pictorial pattern (here a portion of a pattern representing a Pegasus). This element particularly allows verification of the printability of dual-tone patterns by a visual appraisal.

Figure 6:
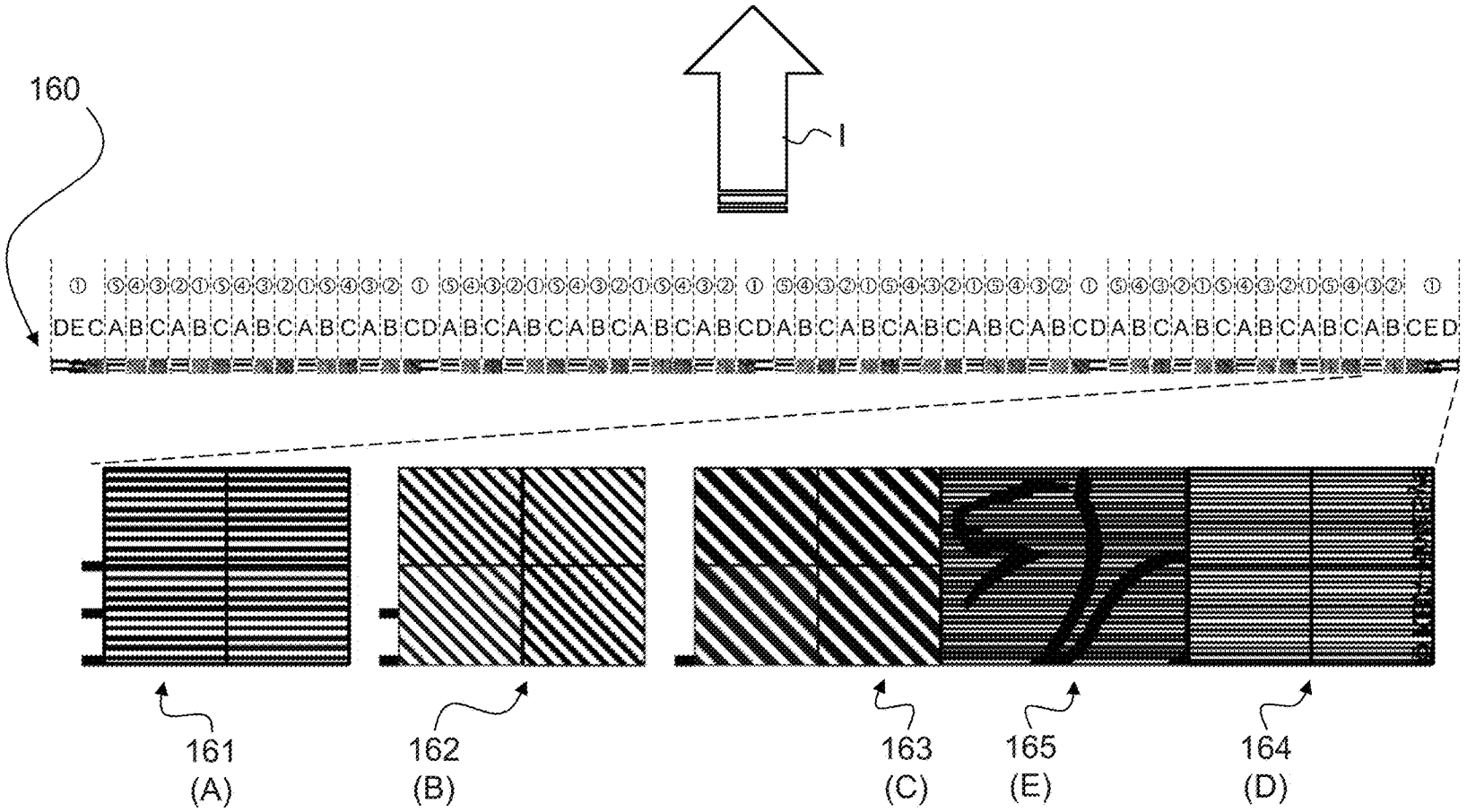
FIG. 6 schematically illustrates printed control zones resulting from the printing of the control strip of FIG. 5.

FIG. 6 schematically illustrates an example of print of the control strip 150 of FIG. 5, the print of the control strip 150 being globally designated by numerical reference 160. As it will be easily understood, the various control areas discussed above are thus reproduced, after intaglio printing of the substrate, in the form of a set of printed control zones corresponding to the various control elements A to E printed in the various colors corresponding to the intaglio inks ① to ⑤ used. In particular, there corresponds to each control area a corresponding printed control zone, numerical references 161 to 165 thus designating printed control zones respectively corresponding to control areas 151 to 155 of FIG. 5. The sets of lines and/or curves constituting the control areas are thus reproduced in the form of corresponding sets of printed lines and/or curves, on which it is possible to carry out measurements, as mentioned hereinafter.

Figure 7:
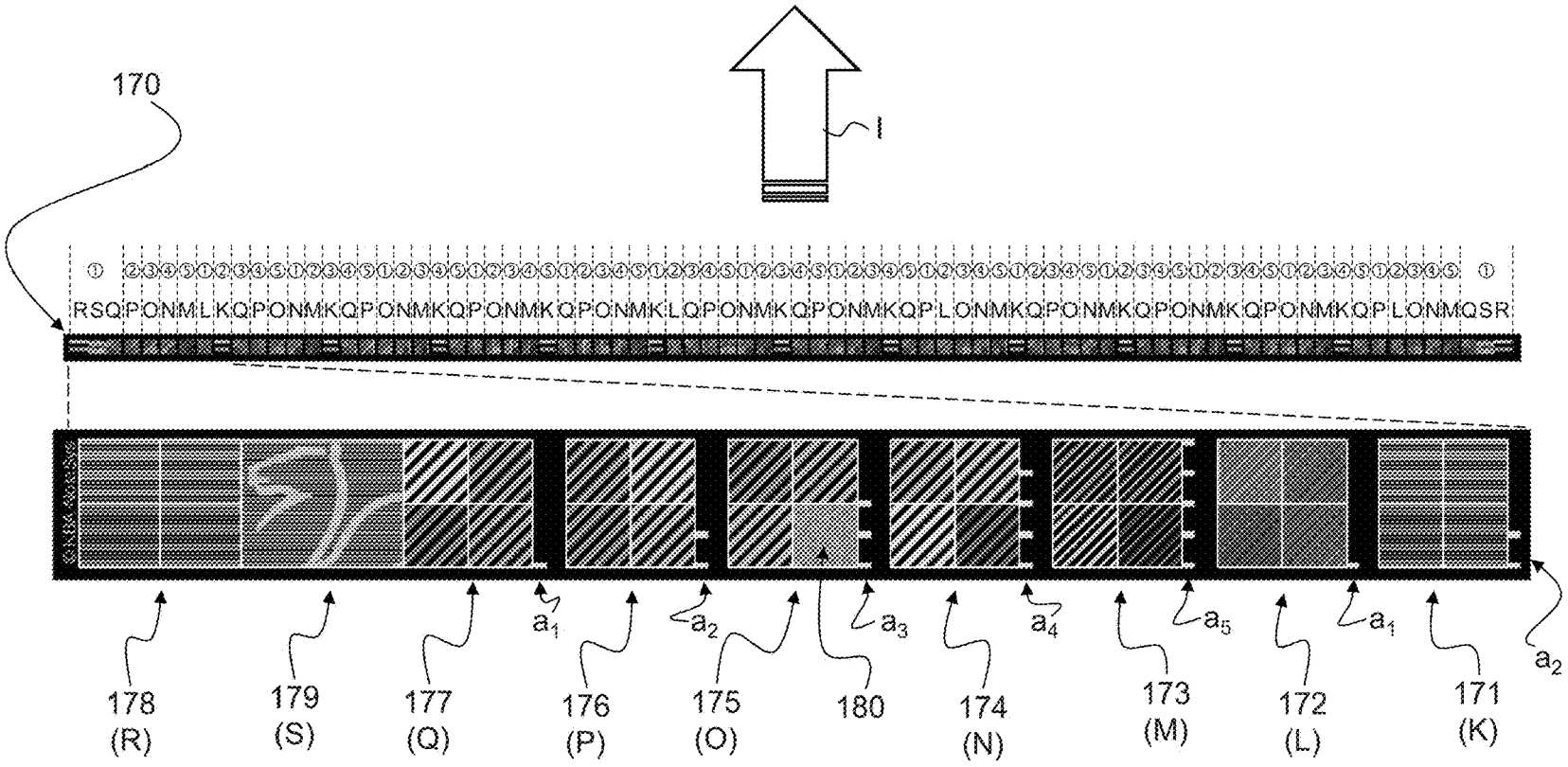
FIG. 7 schematically illustrates another example of a control strip comprising several control areas according to a second embodiment of the invention.

FIG. 7 schematically illustrates another example of a control strip according to a second embodiment of the invention, which control strip is globally designated by numerical reference 170.

Like the control strip 150 illustrated in FIG. 5, the control strip 170 illustrated in FIG. 7 comprises a set of control areas distributed along a direction perpendicular to the printing direction I. More particularly, these control areas are constituted of a predetermined set of control elements (here nine) designated by references K to S in FIG. 7, which are repeated several times transversally to the printing direction I, as illustrated on the upper portion of FIG. 7.

The various control areas of the control strip are each intended to be inked by means of a determined ink. In the illustrated example, the number of inks is likewise five and references ① to ⑤ designate once again the ink by means of which each control area is inked.

The lower portion of FIG. 7 is an enlarged view of the nine first control areas, designated by numerical references 171 to 179, on the left end of the control strip 170. The first control area 171 reflects the features of the first control element K. Likewise, the second to ninth control areas 172 to 179 reflect the features of the second to ninth control elements L to S. The other control areas of the control strip 170, to the right of the control area 171, as represented on the upper portion of FIG. 7, are not detailed on the lower portion of FIG. 7 as they reflect the same structures as those of areas 171 to 179. By way of illustration, the dimensions of the control areas 171 to 177 are of the order of 4 mm in height and 4 mm in width, whereas the dimensions of the two control areas 178 and 179, present only at the two ends of the control strip 170 are of the order of 4 mm in height and 5 mm in width.

Various permutations are undertaken again in such a manner that at least a part of control elements K to S are reproduced in the form of control areas inked by means of the set of five intaglio inks ① to ⑤. In the example illustrated in FIG. 5, only control elements K and M to Q are reproduced in the form of control areas inked by means of the five intaglio inks ① to ⑤. Control elements L, R and S are for their part reproduced in the form of control areas inked by means of a unique or of only a portion of the intaglio inks ① to ⑤. This is again a non-limiting example.

The control areas of control strip 170 allow once again evaluation in particular of the effects of the printing pressure applied during printing of the substrate, and evaluation of the effects of the ink coverage applied during inking of the intaglio printing plate 80.

Given the aforementioned considerations, control elements K to S were designed as follows.

As regards control elements R and S, reproduced in particular in the form of control areas 178 and 179 in FIG. 7, the latter reflect the same features as control elements E and D of FIG. 5. As regards control element K, reproduced in particular in the form of control area 171 in FIG. 7, the goal is to produce, in this example, a set of horizontal lines (that is to say perpendicular to the wiping direction I) similar to the set of lines forming control element R. By way of illustration, it consists in this other example of a set of lines exhibiting a line width (lw) of the order of 60 μm and a line spacing (ls) of the order of 60 μm. Preferably, control element K (as well as control element R) is subdivided into four quarters and the line depth (ld) is different for each quarter, in a range of values lower than 40 μm. By way of example, the four quarters of control element K (and R) exhibit line depths (ld) of 12 μm, 18 μm, 25 μm and 35 μm.

Like control element D of FIG. 5, control elements K and R are mainly used for measuring the effects of the printing pressure.

Control elements M to Q, reproduced in particular in the form of control areas 173 to 177 in FIG. 7, are for their part constituted of a set of lines oriented at ±45° with respect to the printing direction I (like control elements B and C of FIG. 5), subdivided into four quarters. These consist, again by way of illustration, of lines exhibiting a line width (lw) of the order of 100 μm (element M) or 200 μm (elements N to Q) and a line spacing (ls) of the order of 160 μm, the line depth (ld) varying in a range of values going from 8 μm to 70 μm, in the illustrated example.

Control element O illustrated in FIG. 7 differs notably from control elements M, N, P and Q in that its right lower quarter is not constituted of lines, but forms a solid tone, identified by numerical reference 180, namely a substantially continuous region constituted of an engraving of relatively large surface area (with a surface area of the order of 4 $mm^2$ in this example) and a depth of the order of 40 μm with a structuring, or grain, at the bottom of the engraving of the order of 55 μm to 70 μm. The purpose here is to produce an essentially uniform print in which it is possible to carry out a measurement of optical density. A measurement of optical density may also be undertaken on lines, but the solid tone 180 has the advantage of a larger surface area in which it is easier to carry out a measurement of optical density.

It will be understood again that the various quarters constituting control elements M to Q advantageously allow constitution of a sampling of measurements that are representative of printing of engravings of varying depths, particularly engravings the depth of which varies in a range of values lower than or equal to 70 μm. In the present case, control element M allows constitution of a sampling of four measurements (one for each quarter) on four values of different depths (for example 20 μm, 35 μm, 50 μm and 70 μm), which measurements are made on printed lines exhibiting a line width (lw) of 100 μm. Control elements N to Q for their part allow constitution of a sampling of fifteen measurements (one for each quarter, except for the solid tone 180) carried out on fifteen values of different depths (for example 8 μm, 10 μm, 12 μm, 15 μm, 20 μm, 25 μm, 30 μm, 35 μm, 40 μm, 45 μm, 50 μm, 55 μm, 60 μm, 65 μm and 70 μm), which measurements are made on printed lines exhibiting a line width (lw) of 200 μm. In this example, the sampling is more important as regards the lines exhibiting a line width (lw) of 200 μm since these lines are, as already mentioned, more sensitive to variations in the balance between the printing pressure and the ink coverage than the lines of 100 μm in width.

Control element L, reproduced in particular in the form of control area 172 in FIG. 7, is constituted of a set of shallow, fine lines, oriented at ±45° with respect to the printing direction, which set is subdivided into four quarters. It consists in this example of lines exhibiting a line width (lw) as well as a line spacing (ls) of the order of 30 μm, the line depth (ld) of which lines is equivalent to 12 μm, 16 μm, 22 μm or 30 μm, according to the quarter being considered. This control element L may in particular serve as additional control element for measuring the effects of the printing pressure.

It is obviously to be understood that a print of the control strip 170 of FIG. 7, produces a corresponding set of printed control zones reflecting the various control elements K to S printed in the various colors corresponding to the intaglio inks ① to ⑤ used. The set of lines and/or curves constituting the control areas of the control strip 170 are thus reproduced in the form of corresponding sets of printed lines and/or curves, on which it is possible to carry out measurements, as stated hereinafter. This also applies for the solid tone 180.

Other embodiments of the control strip beyond the two variants illustrated in FIGS. 5 and 7, are obviously possible within the context of the present invention.

Figure 8:
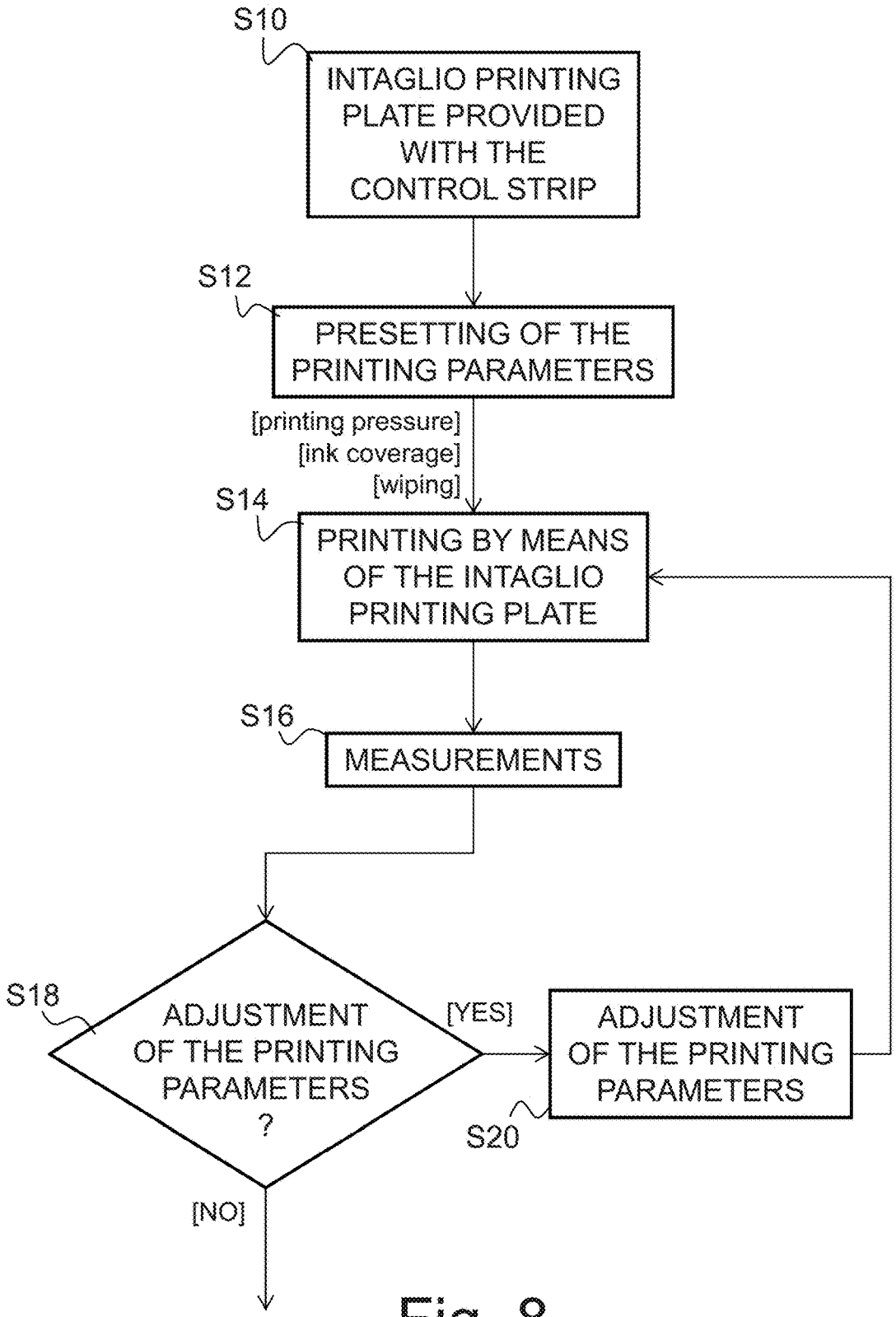
FIG. 8 is a schematic diagram illustrating the steps of a process aimed at adjusting the printing parameters of an intaglio printing press according to an implementation example of the invention.

FIG. 8 is a schematic diagram illustrating the main steps of a process aimed at adjusting the printing parameters of an intaglio printing press (for example a printing press as shown in FIGS. 2 and 3) according to an implementation example of the invention.

This process first implies (step S10) the preparation and provision of an intaglio printing plate (like the intaglio printing plate 80 illustrated in FIG. 4) provided with a control strip according to the invention, for example the aforementioned control strip 150 or 170.

The printer then proceeds (at step S12) with a pre-setting of the printing parameters of the intaglio printing press, particularly of the printing pressure, the ink coverage, and the wiping. One refers here to nominal parameters that are usually recommended by the manufacturer of the intaglio printing press and which should allow carrying out intaglio printing of good quality, it being nevertheless to be understood that a subsequent adjustment of these parameters is usually required in practice.

Once the nominal parameters are preset, the printer may proceed with the printing of test sheets (at step S14) by means of the intaglio printing plate provided with the control strip.

Once intaglio printing is carried out, measurements may be then be undertaken (step S16) on the printed control zones corresponding to the control areas of the control strip, particularly with the purposes of verifying the printing pressure and ink coverage (step S18), and proceed if need be with corresponding adjustments (step S20) before starting a new print.

As already mentioned above, the printer will look in practice for an optimal balance between the printing pressure and the ink coverage, and the measurements carried out in the printed control zones should in particular allow finding this optimal balance. For example, referring to control strip 150 of FIG. 5, control element D should allow verifying if a minimum printing pressure value is reached, and control elements B and C should allow to quantitatively measure the degree of spitting of the lines, that is to say, whether the balance between printing pressure and ink coverage is good or not, this on two types of characteristic lines as stated above. Control element A of control strip 150 allows to complete the analysis by allowing a measurement of the resulting contrast values that are representative of the balance between printing pressure and ink coverage.

According to a preferred embodiment of the invention, one undertakes said quantitative measurements in the printed control zones reproducing lines oriented at ±45° with respect to the printing direction I (like printed control zones 162, 163 reproducing control elements B and C of control strip 150 or printed control zones reproducing control elements M to Q of control strip 170).

These quantitative measurements preferably comprise measurement of raggedness, fill and optical density according to a determined standard, particularly according to the ISO/IEC TS 24790:2012 standard (which is accessible on the website of the International Organization for Standardization, www.iso.org, which standard is incorporated by reference within the context of the present application) the first edition of which was published on Aug. 15, 2012. This standard cancels and replaces the previous standard ISO/IEC 13660:2001 which has been technically revised, but remains relevant where necessary for implementing the present invention.

Figure 9:
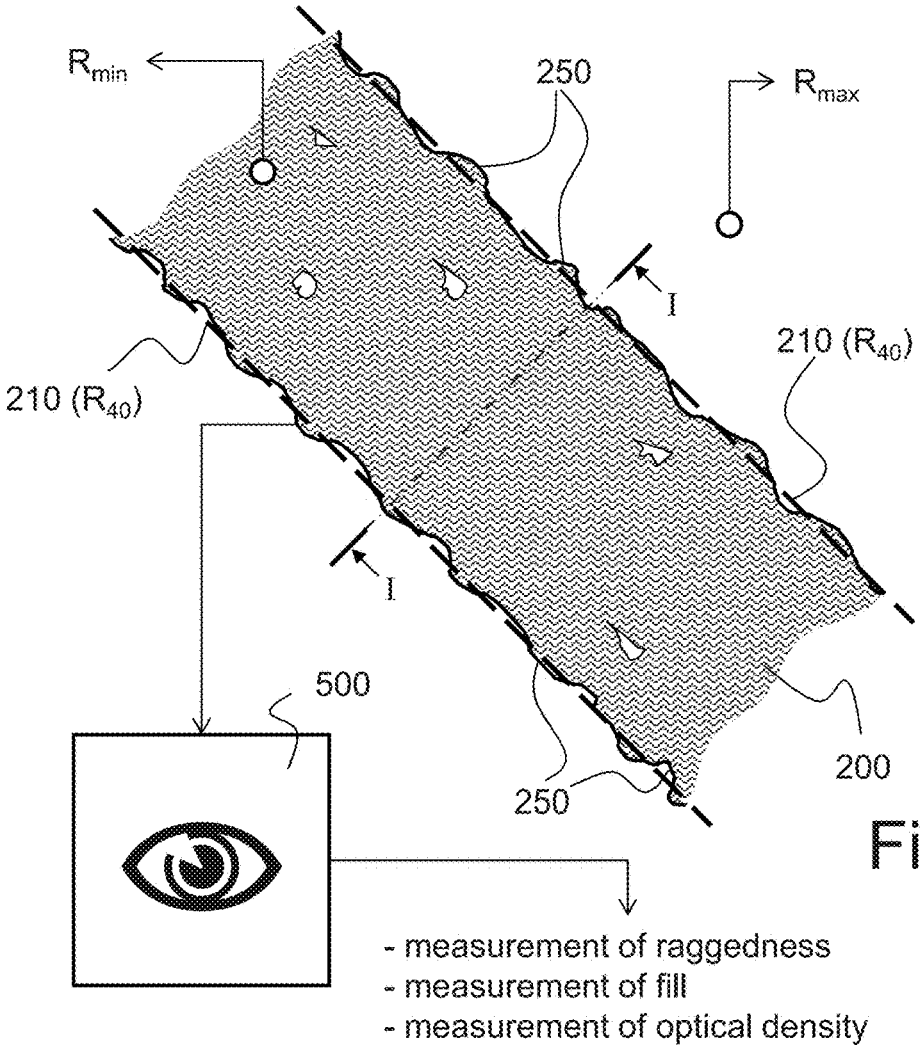
FIG. 9 is a schematic view illustrating a measurement of the raggedness, a measurement of the fill, as well as a measurement of the optical density of a printed line used as control element.
Figure 10:
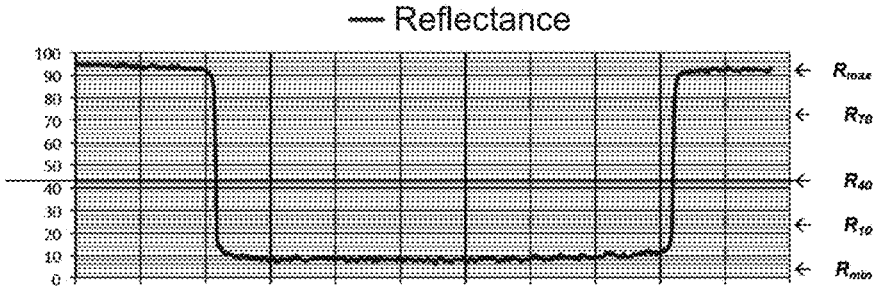
FIG. 10 is a schematic diagram illustrating the variation of the reflectance measured along line I-I in FIG. 9.

The raggedness is in particular measured by determining raggedness within the meaning of clauses 3.28 and 5.3.6 of the ISO/IEC TS 24790:2012 standard. As to the fill, it is measured by determining the fill within the meaning of clauses 3.12 and 5.3.7 of the ISO/IEC TS 24790:2012 standard. As to optical density, the latter is measured according to clauses 3.21 and 3.26 of the ISO/IEC TS 24790:2012 standard. FIGS. 9 and 10 allow illustrating in a more concrete manner what one is talking about, FIG. 9 schematically illustrating a portion of a printed line designated by numerical reference 200. Although FIG. 9 shows a printed line 200 the optical density of which is measured, it is obviously to be understood that the optical density may be measured on any suitable printed structure, particularly a printed zone result of the printing of the solid tone 180 of FIG. 7.

Raggedness according to the ISO/IEC TS 24790:2012 standard is a measurement of the degree of sharpness of a line with respect to a standardized edge threshold. The measurement of raggedness is carried out according to the guidelines mentioned in clause 5.3.6 of the ISO/IEC TS 24790:2012 standard, namely by first determining the edge threshold defined as the reflectance level, $R_{40}$, in a reflectance curve of a line (cf. FIG. 10) corresponding to 40% of the transition from a minimum reflectance value $R_{min}$ (usually corresponding to the measured reflectance of the printed line 200) to a maximum reflectance value $R_{max}$ (usually corresponding to the measured reflectance of a non printed portion of the substrate), as schematically represented on FIG. 9. By way of illustration, the two fictive lines 210 in FIG. 9 schematically illustrate the edge threshold corresponding to the reflectance value $R_{40}$ that has been determined. Then, it is proceeded with a measurement of the standard deviation of the variations, or residuals, 250 with respect to the edge thresholds 210, to lead to a quantification of the raggedness.

Fill according to the ISO/IEC TS 24790:2012 standard is a measurement of the degree (or rate) of fill, carried out according to the guidelines mentioned in clause 5.3.7 of the ISO/IEC TS 24790:2012 standard.

The set of quantitative measurements may be carried out by means of an optical measurement device, designated globally by numerical reference 500 in FIG. 9, for example by means of a LabQMD device as sold by the Applicant.

The transposition in an intaglio printing plate of the control strip and the control areas according to the present invention may be carried out according to the principles already mentioned in International applications WO 03/103962 A1 and WO 2009/138901 A1, jointly with the security pattern which should be intaglio printed. Within this context, the transposition may be achieved, preferably by laser engraving, either directly in a printing plate or indirectly in a printing plate precursor, this precursor then being used to produce several printing plates by galvanic replication.

As proposed in International application WO 03/103962 A1, the transposition of the generated patterns advantageously comprises the generation of a set of three-dimensional digital data constituted of pixels each representing an elementary point to be engraved in the surface of the printing plate or of the printing plate precursor, the engraving as such being operated pixel by pixel on the basis of these three-dimensional digital data.

It is to be understood that the present invention also encompasses any engraved plate for intaglio printing (in particular any intaglio printing plate or any intaglio printing plate precursor) comprising a control strip according to the invention.

Likewise, the present invention also encompasses any digital origination file intended for the production of an intaglio printing plate comprising a set of digital data representative of a security pattern to be engraved, as well as a set of digital data representative of a control strip according to the present invention.

It will be generally understood that various modifications and/or improvements obvious to those skilled in the art may be made to the embodiments described in the present invention without departing from the scope of the invention defined by the accompanying claims.

In particular, the invention is not limited to the control strips and control areas specifically illustrated in FIGS. 5 and 7. Other control patterns, possibly more complex, may be possible, bearing in mind that the control areas should essentially allow measurement of the effects of the intaglio printing parameters, particularly of the printing pressure and the ink coverage. Furthermore, the control strip may be adapted in dependence of the needs, particularly to the number of inks applied on the intaglio printing plate. The invention is as such applicable whatever the number of inks used.

Furthermore, it is possible to define at least certain control areas directly in the security pattern to be printed, instead of or in addition to control areas of a control strip as mentioned above disposed in a margin of the security pattern. The claimed control process is thus not limited to the use of a specific control strip, it being however to be noted that a specific control strip disposed in a margin of the security pattern has the advantage of not affecting the security pattern as such and not restricting the choices of the designers.

It is also to be understood that the aforementioned measurements carried out in the printed control zones may be carried out by means of any suitable measurement tool. It may consist of a LabQMD device as mentioned above or an inspection table of the type described in International application published under No. WO 2012/131581 A1 and sold by the Applicant under the ColorCheck III designation. To this end, an automated or semi-automated control of the intaglio printing quality is perfectly possible within the context of the present invention. It may also be possible to carry out these measurements in-line, during the intaglio printing, for example by means of a suitable inspection device located in the intaglio printing press, like the inspection system 5 shown in FIG. 2.

Furthermore, it is potentially possible to provide control areas allowing evaluation and measurement of the wiping of the printing plate, another parameter characterizing intaglio printing. This being said, it is preferable to evaluate the quality of wiping over the entire printed substrate and proceed if need be with corresponding adjustments. A measurement of the wiping by means of one or several control areas may not necessarily be representative of the wiping quality over the entire printed substrate.

Lastly, the present invention is not limited by the type of measurements discussed above, any other measurement allowing to quantify the intaglio printing quality being possible. It may for example be envisaged to adopt the techniques described in International applications published under Nos. WO 2008/146262 A2 and WO 2011/018764 A2 as means for evaluating the quality of the intaglio print. The measurements of raggedness, fill, optical density and where necessary contrast mentioned above nevertheless prove to be very advantageous within the context of the present invention for quantifying the quality of intaglio printing.

LIST OF REFERENCES USED IN THE PRESENT APPLICATION

1 sheet-fed intaglio printing press
2 sheet feeder unit
3 intaglio printing unit
4 sheet delivery unit (with three piles)
5 optical inspection system (for example NotaSave®)
6 drying or curing unit
7 impression cylinder (three-segment cylinder)
7*a* cylinder pits of the impression cylinder 7
7*b* segments of the impression cylinder 7
8 plate cylinder (three-segment cylinder bearing three intaglio printing plates)
8*a* cylinder pits of the plate cylinder 8
8*b* segments of the plate cylinder 8
9 ink collecting cylinder/Orlof cylinder (three-segment cylinder)
10 ink wiping system
11 rotatable wiping cylinder (or roller) of the ink wiping system 10 (cooperates with the circumference of the plate cylinder 8)
15 sheet transporting system (system for conveying sheets comprising a pair of endless chains driving a plurality of spaced-apart gripper bars holding the sheets by their leading portion)
20 (five) inking devices
21 ink duct
22 ink application rollers
23 (five) chablon cylinders/color selecting cylinders transferring ink to the ink collecting cylinder 9
50 stationary frame supporting the impression cylinder 7, the plate cylinder 8 and the ink wiping system 10
51 intermediate carriage supporting the ink collecting cylinder 9 and the chablon cylinders 23
52 inking carriage supporting the inking devices 20
52' inking carriage 52 in retracted position
80 intaglio printing plate/engraved plate
I printing direction (also corresponds to the wiping direction)
100 security pattern (individual note)
100A set of security patterns 100 provided on a same intaglio printing plate 80
150 control strip (first variant)
151 to 155 control areas of the control strip 150 (control elements A to E)
160 print corresponding to the control strip 150
161 to 165 printed control zones corresponding to printing of the control areas 151 to 155 (control elements A to E)
A to E first to fifth control elements of the control strip 150 (control areas 151 to 155/printed control zones 161 to 165)
170 control strip (second variant)
171 to 179 control areas of the control strip 170 (control elements K to S)
K to S first to ninth control elements of the control strip 170 (control areas 171 to 179)
a1 color/chablon index (first intaglio ink/first chablon cylinder)
a2 color/chablon index (second intaglio ink/second chablon cylinder)
a3 color/chablon index (third intaglio ink/third chablon cylinder)
a4 color/chablon index (fourth intaglio ink/fourth chablon cylinder)
a5 color/chablon index (fifth intaglio ink/fifth chablon cylinder)
① zone inked with a first intaglio ink (first chablon cylinder)
② zone inked with a second intaglio ink (second chablon cylinder)
③ zone inked with a third intaglio ink (third chablon cylinder)
④ zone inked with a fourth intaglio ink (fourth chablon cylinder)
⑤ zone inked with a fifth intaglio ink (fifth chablon cylinder)
S10 provision of an intaglio printing plate provided with a control strip according to the invention
S12 presetting of the printing parameters (nominal printing parameters) of the intaglio printing press
S14 printing of a substrate by means of the intaglio printing plate provided with the control strip 150
S16 measurements carried out in the printed control zones resulting from the printing of the control strip
S18 evaluation of the printing parameters (printing pressure, ink coverage, wiping)
S20 adjustment of the printing parameters
200 printed line (for example printed line oriented at ±45° with respect to the printing direction I)
lw line width
ls line spacing
ld line depth
$R_{min}$ minimum reflectance value (printed zone) measured according to the ISO/IEC TS 24790:2012 standard (clause 3.32, Annex D)
$R_{max}$ maximum reflectance value (unprinted zone) measured according to the ISO/IEC TS 24790:2012 standard (clause 3.30, Annex D)
210 edge thresholds 200 determined according to the ISO/IEC TS 24790:2012 standard ("edge threshold $R_{40}$", clause 3.11)/relevant for the measurement of raggedness (clause 5.3.6)
250 residuals on either side of the lines coinciding with the edge thresholds 210/relevant for the measurement of raggedness (clause 5.3.6)
500 measurement device (complying with the ISO/IEC TS 24790:2012 standard)

The invention claimed is:

1. A control process for intaglio printing, for printing paper securities, said intaglio printing involving:
(i) inking of at least one intaglio printing plate with at least one intaglio ink;
(ii) wiping of the intaglio printing plate thus inked; and
(iii) printing of a substrate by means of the intaglio printing plate thus wiped, printing of the substrate involving application of the substrate against the intaglio printing plate at a printing pressure,
printing pressure, ink coverage and wiping constituting printing parameters that are liable to affect said intaglio printing,
wherein the control process comprises the following steps:
(a) defining on the intaglio printing plate control areas designed in such a manner as to allow in particular evaluation of effects of the printing pressure applied during printing (iii) of the substrate and evaluation of effects of the ink coverage applied during inking (i) of the intaglio printing plate, which control areas are engraved in a portion of the intaglio printing plate in order to produce corresponding printed control zones on said substrate;

(b) carrying out measurements in said printed control zones allowing evaluation of the printing pressure applied during printing (iii) of the substrate; and (c) carrying out measurements in said printed control zones allowing evaluation of the ink coverage applied during inking (i) of the intaglio printing plate, wherein said control areas are subdivided into four quarters having line depths and the line depth is different for each quarter, wherein said quarters of at least one of said control areas comprise a set of lines and/or curves of varying depths in a range of values lower than or equal to 40 μm, wherein the measurements carried out in that printed control zone allow constitution of a sampling of measurements that are representative of printing of engravings of varying depths.

2. The process according to claim 1, wherein the printing pressure and the ink coverage are adjusted until the measurements carried out in said printed control zones reflect an optimal balance between the printing pressure and the ink coverage.

3. The process according to claim 1, wherein the intaglio printing plate is inked by means of a plurality of different inks, said control areas comprising at least one control area for each ink used, and in that the measurements carried out in said printed control zones are undertaken for each ink individually.

4. The process according to claim 1, wherein the measurements carried out in said printed control zones include measurement of raggedness, measurement of fill, and measurement of optical density in accordance with a determined measurement standard.

5. The process according to claim 4, wherein said determined measurement standard is the ISO/IEC 13660:2001 standard or the ISO/IEC TS 24790:2012 standard.

6. The process according to claim 4, wherein the measurement of raggedness, the measurement of fill, and the measurement of optical density are carried out on printed lines substantially oriented at ±45° with respect to a printing direction.

7. The process according to claim 6, wherein the printed lines on which the measurement of raggedness, the measurement of fill, and the measurement of optical density are carried out exhibit a line width ranging between 30 μm and 200 μm.

8. The process according to claim 4, wherein the measurements carried out in said printed control zones further include the measurement of a contrast.

9. The process according to claim 1, wherein the measurements carried out in said printed control zones allow constitution of a sampling of measurements that are representative of printing of engravings the depth of which varies within a range of values lower than or equal to 70 μm.

10. The process according to claim 1, wherein it further comprises a step which consists in verifying printability of a security pattern which is to be printed by intaglio printing by means of the intaglio printing plate, once a printer has carried out a desired setting of said printing parameters.

11. The process according to claim 1, wherein the printing parameters of an intaglio printing press are controlled and, if need be, adjusted according to the measurements carried out in the printed control zones.

12. The process according to claim 1, wherein the control areas comprise control areas of a control strip located in a margin of a security pattern and/or control areas defined directly within the security pattern.

* * * * *